US011519250B2

(12) United States Patent
Zhu

(10) Patent No.: US 11,519,250 B2
(45) Date of Patent: Dec. 6, 2022

(54) NOZZLE FOR STEAM INJECTION

(71) Applicant: Veriperm Energy Services Inc., Calgary (CA)

(72) Inventor: Da Zhu, Calgary (CA)

(73) Assignee: Variperm Energy Services Inc., Calgary (CA)

( * ) Notice: Subject to any disclaimer, the term of this patent is extended or adjusted under 35 U.S.C. 154(b) by 0 days.

(21) Appl. No.: 17/054,120

(22) PCT Filed: May 10, 2019

(86) PCT No.: PCT/CA2019/050636
§ 371 (c)(1),
(2) Date: Nov. 9, 2020

(87) PCT Pub. No.: WO2019/213782
PCT Pub. Date: Nov. 14, 2019

(65) Prior Publication Data

US 2021/0115769 A1 Apr. 22, 2021

Related U.S. Application Data

(60) Provisional application No. 62/669,802, filed on May 10, 2018.

(51) Int. Cl.
*E21B 41/00* (2006.01)
*E21B 43/24* (2006.01)
*F22B 37/22* (2006.01)

(52) U.S. Cl.
CPC ..... *E21B 43/24* (2013.01); *E21B 41/0078* (2013.01); *F22B 37/222* (2013.01)

(58) Field of Classification Search
CPC ..... E21B 41/0078; E21B 43/24; F22B 37/222
See application file for complete search history.

(56) References Cited

U.S. PATENT DOCUMENTS 4,648,455 A * 3/1987 Luke ..... E21B 43/162 166/242.2
5,092,159 A * 3/1992 Chien ..... E21B 43/24 73/29.03
5,141,055 A * 8/1992 Chien ..... E21B 43/12 166/272.3

(Continued)

FOREIGN PATENT DOCUMENTS

CA 2622939 A1 10/2008
CA 2679148 A1 3/2010

(Continued)

OTHER PUBLICATIONS

International Search Report and Written Opinion received for PCT/CA2019/050636 dated Jul. 17, 2019, 8 pgs.

(Continued)

*Primary Examiner* — Matthew R Buck
(74) *Attorney, Agent, or Firm* — Michael A. Bondi; Moss & Barnett

(57) ABSTRACT

A steam injection nozzle for controlling the flowrate of steam injected into a hydrocarbon containing reservoir comprises a passage extending between an inlet and an outlet, wherein the passage comprises a first, pressure dissipating section and a second, pressure recovery section.

18 Claims, 5 Drawing Sheets

(56) References Cited

U.S. PATENT DOCUMENTS

| | | | | |
|---|---|---|---|---|
| 6,524,368 | B2 * | 2/2003 | Betting | B01D 45/16 95/29 |
| 6,708,763 | B2 * | 3/2004 | Howard | E21B 41/0078 166/222 |
| 7,419,002 | B2 | 9/2008 | Dybevik | |
| 7,537,056 | B2 | 5/2009 | MacDougall | |
| 8,474,535 | B2 | 7/2013 | Richards | |
| 8,496,059 | B2 | 7/2013 | Schultz | |
| 8,689,883 | B2 | 4/2014 | Kim | |
| 9,027,642 | B2 | 5/2015 | Sladic | |
| 9,249,649 | B2 | 2/2016 | Fripp | |
| 9,475,174 | B2 * | 10/2016 | Hursen | E21B 7/18 |
| 9,518,455 | B2 | 12/2016 | Franklin | |
| 9,631,461 | B2 | 4/2017 | Lopez | |
| 9,638,000 | B2 | 5/2017 | Dyck | |
| 2002/0162589 | A1 | 11/2002 | Lorch | |
| 2006/0048942 | A1 | 3/2006 | Moen | |
| 2006/0118296 | A1 | 6/2006 | Dybevik | |
| 2008/0041588 | A1 | 2/2008 | Richards | |
| 2008/0283238 | A1 | 11/2008 | Richards | |
| 2011/0198097 | A1 | 8/2011 | Moen | |
| 2012/0006563 | A1 | 1/2012 | Patel | |
| 2014/0319970 | A1 | 10/2014 | Sherrit | |
| 2015/0292300 | A1 | 10/2015 | Franklin | |
| 2016/0010425 | A1 | 1/2016 | Dyck | |
| 2016/0160616 | A1 | 6/2016 | Moen | |
| 2017/0044868 | A1 | 2/2017 | Van Petegem | |
| 2017/0058655 | A1 | 3/2017 | Lastiwka | |
| 2018/0030812 | A1 | 2/2018 | Ning | |
| 2018/0045027 | A1 | 2/2018 | Haley | |

FOREIGN PATENT DOCUMENTS

| | | | |
|---|---|---|---|
| CA | 2862161 | A1 | 5/2013 |
| CA | 2862111 | A1 | 8/2013 |
| CA | 2871354 | A1 | 1/2015 |
| CA | 2917392 | A1 | 2/2015 |
| CA | 2934369 | A1 | 6/2015 |
| CA | 2887860 | A1 | 1/2017 |
| CA | 2959880 | A1 | 9/2017 |
| CA | 2871354 | A1 | 6/2019 |
| WO | 2019/090425 | A1 | 3/2019 |
| WO | 2020/069614 | A1 | 4/2020 |

OTHER PUBLICATIONS

Non-Final Office Action received for U.S. Appl. No. 17/264,215 dated Jun. 4, 2021, 9 pgs.

International Search Report and Written Opinion received for PCT serial No. PCT/CA2019/050942 dated Sep. 17, 2019.

International Search Report and Written Opinion received for PCT serial No. PCT/CA2019/051407 dated Dec. 12, 2019.

* cited by examiner

NOZZLE FOR STEAM INJECTION

CROSS REFERENCE TO PRIOR APPLICATIONS

The present application claims priority under the Paris Convention to U.S. Application No. 62/669,802, filed May 10, 2018, the entire contents of which are incorporated herein by reference.

FIELD OF THE DESCRIPTION

The present description relates to flow control devices used for controlling flow of steam injected into hydrocarbon bearing formations. In particular, the description relates to a nozzle for dissipating and recovering pressure of steam injected into formations.

BACKGROUND

Subterranean hydrocarbon reservoirs are generally accessed by one or more wells that are drilled into the reservoir to produce the hydrocarbon materials contained therein. Such materials are then brought to the surface through production tubing.

The wells drilled into the reservoirs may be vertical or horizontal or at any angle there-between. In some cases, where the hydrocarbons comprise a highly viscous material, such as heavy oil and the like, steam, gas or other lower viscosity fluids may be injected into one or more sections of the reservoir to stimulate the flow of hydrocarbons into production tubing provided in the wellbore. Steam Assisted Gravity Drainage, "SAGD", is one example of a process that is used to stimulate the flow of highly viscous oil. In a SAGD operation, one or more well pairs, where each pair comprises two vertically separated horizontal wells, are drilled into a reservoir. Each of the well pairs typically comprises a steam injection well and a production well, with the steam injection well being positioned generally vertically above the production well. In operation, steam is injected into the injection well to heat and reduce the viscosity of the hydrocarbon materials in its vicinity, in particular viscous, heavy oil material. After steam treatment, the hydrocarbon material, now mobilized, drains into the lower production well owing to the effect of gravity, and is subsequently brought to the surface through the production tubing.

Cyclic Steam Stimulation, "CSS", is another hydrocarbon production method where steam is used to enhance the mobility of viscous hydrocarbon materials. In a CSS process, a single well is used to first inject steam for a period of time into the reservoir through tubing. Thereafter, steam injection may be ceased and the heat from the injected steam is allowed to be absorbed into the reservoir (a stage referred to as "shut in" or "soaking"), during which the viscosity of the hydrocarbon material is reduced. Following such stage, the hydrocarbons, now mobilized, are produced in a production stage, often through the same tubing.

Tubing used in wellbores typically comprises a number of coaxial segments, or tubulars, that are connected together. Various tools may also be provided along the length of the tubing and positioned in lines with the tubulars. The tubing, for either steam injection or hydrocarbon production, generally includes a number of apertures, or ports, along their lengths. The ports provide a means for injection of steam, and/or other viscosity reducing agents, or for the inflow of hydrocarbon materials from the reservoir into the pipe and thus into the production tubing. The segments of tubing having ports are also often provided with one or more filtering devices, such as sand screens, which serve to prevent or mitigate against sand and other solid debris in the well from entering the tubing.

As known in the art, due to the length of tubing that is used in a typical hydrocarbon well (which may be in the range of several thousand meters), steps must often be taken to ensure that the injection of steam and/or other such materials is accomplished evenly along the length of the tubing, or at specific desired locations, so as to avoid preferential stimulation of one or more regions of the reservoir over others. Similar steps are often also required for ensuring that even production of hydrocarbon materials occurs along the length of the production tubing.

Various devices have been proposed for controlling the rates of production and/or injection between tubing and a reservoir. In some cases, a device such as a flow restrictor or similar nozzle is associated with the "base pipe" of the tubing to impede the flow of fluids flowing into or from the pipe. Examples of such flow control devices are described in the following references: U.S. Pat. Nos. 9,518,455; 9,638,000; 9,027,642; 7,419,002; 8,689,883; and, 9,249,649.

There exists a need for an improved flow control means to control the flow of steam injected into a reservoir.

SUMMARY OF THE DESCRIPTION

In one aspect, the present description provides a nozzle for steam injection having a structure to adjust the pressure and velocity characteristics of the steam in a predetermined manner. The nozzle achieves this by being provided with an internal geometry that adjusts the flow characteristics of a fluid, such as steam, flowing there-through.

In another aspect, there is provided a steam injection apparatus for injecting steam into a reservoir, comprising a base pipe and one or more nozzles described herein.

In another aspect, there is provided a method of tailoring the flow characteristics of a fluid, such as steam, but subjecting the fluid to constricted and divergent regions.

Thus, in one aspect, there is provided a steam injection nozzle for a pipe, the nozzle having:

- an inlet and an outlet and a passage extending from the inlet to the outlet, the passage comprising:
- a pressure dissipation section downstream of the inlet, the pressure dissipation section comprising:
  - a first convergence zone downstream of the inlet, the first convergence zone comprising a region of reducing cross-sectional area;
  - a first divergence zone downstream of the first convergence zone, the first divergence zone comprising a region of increasing cross-sectional area; and,
  - a first region, downstream of the first divergence zone, comprising a region of generally constant cross-sectional area; and,
- a pressure recovery section downstream of the pressure dissipation section and upstream of the outlet, the pressure recovery section comprising:
- a second divergence zone, comprising a region of increasing cross-sectional area.

In another aspect, the pressure recovery section of the steam injection nozzle further comprises:

- a second convergence zone downstream of the pressure dissipation zone and upstream of the second divergence zone, the second convergence zone comprising a region of reduced cross-sectional area.

In another aspect, the pressure recovery section of the steam injection nozzle further comprises:

a second region, downstream of the second convergence zone and upstream of the second divergence zone, comprising a region of generally constant cross-sectional area.

In another aspect, there is provided an apparatus for injection of steam into a subterranean reservoir, the apparatus comprising:

a base pipe for communicating fluids from the surface to the subterranean reservoir, the base pipe having at least one port extending through the wall thereof, the port being adapted to permit passage of steam from the base pipe into the reservoir;

a nozzle provided on or adjacent to the port and being retained against the base pipe;

the nozzle comprising:

an inlet and an outlet and a passage extending from the inlet to the outlet, the passage having:

a pressure dissipation section downstream of the inlet, the pressure dissipation section comprising:

a first convergence zone downstream of the inlet, the first convergence zone comprising a region of reducing cross-sectional area;

a first divergence zone downstream of the first convergence zone, the first divergence zone comprising a region of increasing cross-sectional area; and, a first region, downstream of the first divergence zone, comprising a region of generally constant cross-sectional area; and, a pressure recovery section downstream of the pressure dissipation section and upstream of the outlet, the pressure recovery section comprising:

a second divergence zone, comprising a region of increasing cross-sectional area.

In another aspect, there is provided a method of injecting steam into a subterranean reservoir, the method comprising:

injecting steam from the surface into the reservoir through a base pipe, the base pipe having at least one port extending through the wall thereof and a nozzle associated with the port, wherein the steam is passed from the port through an inlet of the nozzle and through an outlet of the nozzle and into the reservoir;

wherein, during passage through the nozzle the injected steam is:

(a) subjected to a pressure dissipation downstream of the inlet, the pressure dissipation involving:

passing the steam through a first convergence zone downstream of the inlet, the first convergence zone comprising a region of reducing cross-sectional area;

passing the steam through a first divergence zone downstream of the first convergence zone, the first divergence zone comprising a region of increasing cross-sectional area; and, passing the steam through a first region, downstream of the first divergence zone, comprising a region of generally constant cross-sectional area; and, (b) subjected to a pressure recovery after the pressure dissipation, the pressure recovery comprising:

passing the steam through a second divergence zone, comprising a region of increasing cross-sectional area.

In another aspect, step (b) of the method further comprises passing the steam through a second convergence zone downstream of the first region and upstream of the second divergence zone, the second convergence zone comprising a region of reducing cross-sectional area.

In another aspect, step (b) of the method further comprises passing the steam through a second region, downstream of the second convergence zone and upstream of the second divergence zone, comprising a region of generally constant cross-sectional area.

BRIEF DESCRIPTION OF THE FIGURES

The features of certain embodiments will become more apparent in the following detailed description in which reference is made to the appended figures wherein.

DETAILED DESCRIPTION

Figure 1:
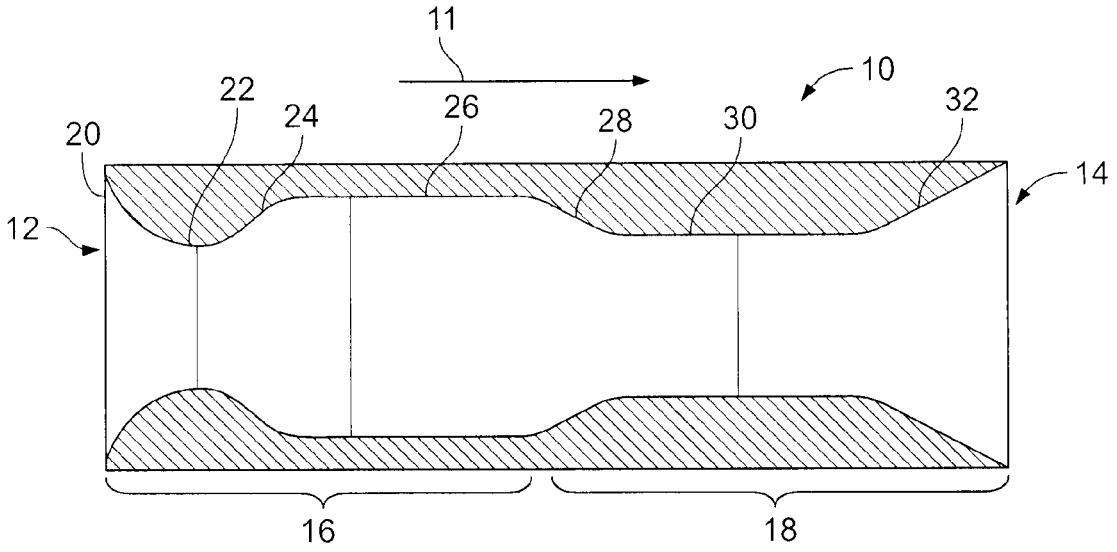
FIG. 1 is a side cross-sectional view of a steam injection nozzle according to an aspect of the description.

As used herein, the terms "nozzle" or "nozzle insert" will be understood to mean a device that controls the flow of a fluid flowing there-through. In one example, the nozzle described herein serves to control the flow of a fluid through a port in a pipe in at least one direction.

The term "hydrocarbons" refers to hydrocarbon compounds that are found in subterranean reservoirs. Examples of hydrocarbons include oil and gas.

The term "wellbore" refers to a bore drilled into a subterranean formation, such as a formation containing hydrocarbons.

The term "wellbore fluids" refers to hydrocarbons and other materials contained in a reservoir that are capable of entering into a wellbore.

The terms "pipe" or "base pipe" refer to a section of pipe, or other such tubular member. The base pipe is generally provided with one or more openings, referred to as ports or slots, along its length to allow for flow of fluids there-through. For the purpose of the present description, the term "port" will be used to indicate such openings, as would be known in the art.

The term "production" refers to the process of producing wellbore fluids.

The term "production tubing" refers to a series of pipes, or tubulars, connected together and extending through a wellbore from the surface into the reservoir.

The terms "screen", "sand screen", "wire screen", or "wire-wrap screen", as used herein, refer to known filtering or screening devices that are used to inhibit or prevent sand or other solid material from the reservoir from flowing into the pipe. Such screens may include wire wrap screens, precision punched screens, premium screens or any other screen that is provided on a base pipe to filter fluids and create an annular flow channel. The present description is not limited to any particular screen described herein.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art.

In the present description, the terms "top", "bottom", "front" and "rear" may be used. It will be understood that the use of such terms is purely for the purpose of facilitating the present description and are not intended to be limiting in any way unless indicated otherwise. For example, unless indicated otherwise, these terms are not intended to limit the orientation or placement of the described elements or structures.

As described herein, there is provided a nozzle that can be incorporated into a steam outflow control device, "OCD", that aims to throttle or choke the flow of steam from the lumen of a pipe through a port provided in the pipe wall. Although reference will be made herein to the flow of steam, it will be understood that the devices described herein would be applicable to any fluid. As noted above, it is desired in a steam injection process to have the flow of steam occur evenly along the length of a given tubing. It is also desired to achieve a desired steam flowrate through the pipe (or tubing) without the need to increase the supply pressure of the steam (that is, the pressure of the steam upstream of the nozzle). For example, it is desired to provide a nozzle for steam injection that allows steam to be injected at very high velocities (such as sonic or supersonic velocities) without the need for increasing the upstream steam injection pressure. The nozzles described herein serve to achieve at least one of these goals.

As would be understood by persons skilled in the art, the nozzles described herein are designed to be included as part of an apparatus associated with tubing. That is, the nozzles are adapted to be secured to tubing, at the vicinity of one or more ports provided on the tubing. The nozzles are retained in position by any means, such as by collars or the like commonly associated with sand control devices, such as wire wrap screens etc. In another aspect, the present nozzles may be located within slots or openings cut into the wall of the pipe or tubing. It will be understood that the means and method of securing the nozzle to the pipe is not limited to the specific descriptions provided herein and that any other means or method may be used, while still retaining the functionality described herein. Once steam exits the nozzle, it may be diverted in one or more directions before finally exiting into the reservoir.

FIG. 1 illustrates one aspect of a nozzle according to the present description. As shown, the nozzle 10 comprises an inlet 12 and an outlet 14 and a passage extending there-through. Steam flows through the nozzle 10 in the direction shown by arrow 11. The inlet 12 receives steam from the interior of a pipe (not shown). After passing through the nozzle 10, the steam exits through the outlet 14. As described above, and as would be understood by persons skilled in the art, after leaving the outlet 14, the steam may directly enter the reservoir or may pass through a diverter or the like. In FIG. 1, the nozzle 10 is depicted having a generally cylindrical passage extending there-through. It will, however, be understood that the passage may have any shape, such as square, rectangular etc. Various shapes of the passage would be appreciated by persons skilled in the art. For illustration purposes, the present description will, however, be described in reference to a nozzle having a generally cylindrical passage. Although such a configuration would be preferred, it is not intended to limit the present description to any particular shape or profile of the nozzle or the passage there-through.

The nozzle 10 comprises a first section 16 and a second section 18. The first section 16 of the nozzle 10 comprises a Venturi, having a converging/diverging profile in cross section, as shown in FIG. 1. More particularly, and as illustrated, the inlet 12 of the nozzle 10 includes an opening 20 of a first cross-sectional area. In one example, the opening 20 has a generally end circular cross-sectional shape. The cross-section, or cross-sectional area, of the inlet 12 then reduces along the direction 11 to create a first convergence zone 22 where flow of steam is forced through a narrower passage, or throat. As would be understood, in the first convergence zone 22, the pressure of the steam flowing through the nozzle 10 is reduced while its velocity is increased. In the example illustrated in FIG. 1, which illustrates a generally cylindrical geometry, the first diameter of the opening 20 may be about 12 mm, whereas the narrowest diameter of the convergence zone 22 may be about 4 mm. It will be understood that, for cross-sections of other geometries, the aforementioned dimensions may be the minimum dimensions. For example, for a rectangular cross-section, the convergence zone may have a height of 4 mm and a width that is longer.

Immediately following the first convergence zone 22, the nozzle 10 includes a region of widening cross-sectional area, resulting in a first divergence zone 24. This section of the nozzle 10 has an increasing cross-sectional area, whereby, for steam flowing there-through, at least some of the pressure lost in passing through the first convergence zone 22 is recovered. As shown in the example of FIG. 1, where the nozzle 10 has a generally cylindrical opening, the diameter of the nozzle 10 may be increased to about 5.2 mm in the first divergence zone 24. As discussed above, the nozzles described herein are not limited to any particular cross-sectional geometry. Furthermore, all dimensions provided herein are solely meant to illustrate the nozzle and are not intended to limit the scope of the description.

As shown in FIG. 1, the first convergence zone 22 and first divergence zone 24 may be provided with relatively smooth transitions in the passage extending through the nozzle 10. That is the passage of the nozzle 10 may be provided with gradually curved walls as shown in FIG. 1. This may be desirable for preventing turbulence in the fluid flowing through the nozzle 10. However, in some cases, the passage through the nozzle may have straight walls, whereby the first convergence and divergence zones are still formed in a smooth manner but without the curved walls as illustrated.

In the example of the nozzle shown in FIG. 1, downstream of the first divergence zone 24 there is provided a first constant cross-sectional area region 26, where the cross-sectional area the nozzle 10 is maintained generally constant for a certain length. As used throughout this description, the term "generally constant" will be understood to mean that that the quantity in question (such as the cross-sectional area) may be the same or vary by some inconsequential degree. For example, the variation may be +/−10%.

In one aspect, the first region 26 comprises a generally cylindrical region having a generally constant diameter. As discussed above, it will be understood that the first region 26 may have any other geometry in cross-section, such as square, rectangular etc. In one example, the first constant cross-sectional area region 26 may have a diameter, or minimum dimension, of about 5.2 mm.

As shown in FIG. 1, the second section 18 of the nozzle 10 is provided downstream (that is, in the direction 11) of the first divergence zone 24. Generally, the second section 18 serves to recover the pressure of the steam that is lost in passing through the first, Venturi section 16. In the aspect shown in FIG. 1, the second, or pressure recovery section 18 as illustrated accomplishes pressure recovery by creating a number of shock waves in the steam passing through the nozzle 10. In the example shown in FIG. 1, the geometry of the nozzle 10 results in the generation of multiple shock waves in the steam flow, with such shock waves propagating in oblique directions with respect to the flow direction 11, and at least another shock wave in the flowing steam that is normal to the flow direction 11. Specifically, in the example illustrated in FIG. 1, the second section 18 comprises a second convergence zone 28, where the cross-sectional area of the passage through the nozzle 10 is again reduced, this time downstream of the first divergence zone 24. In the example shown, the second convergence zone 28 of the second section 18 is provided with generally straight walls, thereby resulting, in one aspect, in a conical geometry for the second convergence zone 28. Downstream of the second convergence zone 28, the second section 18 is provided with a second generally constant cross-sectional area region 30, where the cross-sectional area of the passage of the nozzle 10 is generally constant for a length. In the example shown in FIG. 1, the second convergence zone 28 may have a length of about 20 mm and the second generally constant cross-sectional area region 30 may have a length of about 50 mm. It will be understood that the present description is not limited to any particular dimensions or lengths etc. As also shown in the example of FIG. 1, the second convergence zone 28 may comprise a reduced cross-sectional area of the passage through the nozzle 10 from about 5.2 mm (i.e. the diameter of the constant diameter region 26) to about 4.5 mm. This cross-sectional area is then maintained through the second generally constant cross-sectional area region 30.

Downstream of the second region 30, the second, or pressure recovery section 18 of the nozzle 10 is provided with a second divergence zone 32, which comprises a zone of expanding cross-sectional area of the passage through the nozzle 10. In the example illustrated in FIG. 1, the second divergence zone 32 of the second section 18 comprises a generally conical shape, with generally straight walls where the diameter of the second divergence zone 32 is gradually increased. Although this description is offered in terms of a generally circular shape of the passage, it will be understood that other cross-sectional shapes are within the scope of the present description. As shown, the second divergence zone 32 terminates at the outlet 14 of the nozzle 10.

In the example shown in FIG. 1, the second divergence zone 32 may have a length of about 30 mm and a diameter that gradually increases from about 4.5 mm (the diameter of the cylindrical region 30) to about 15 mm. As discussed above, the term "diameter" as used herein may refer to the minimum dimension for non-circular cross-sectional geometries. As also mentioned above, the values of the lengths and other dimensions are not intended to limit the present description in any way. The nozzles described herein may be of any size or dimension.

In operation, steam (or other fluid) passing through the first, Venturi section 16, enters the second, pressure recovery, section 18 and encounters the first convergence section 28 and first generally constant cross-sectional area region 30. The first convergence section 28 and first region 30 result in the generation of a plurality of first pressure shock waves that reverberate through the steam in oblique directions with respect to the direction of flow 11. In addition, the second divergence zone 32 of the second, pressure recovery section 18 serves to generate further, second pressure shock waves in the steam. The second shock waves would generally be propagated in a direction normal to that of the flowing steam (i.e. arrow 11). The generation of such multiple shock waves in the steam results in an increase in the pressure of the steam within the nozzle 10, thereby resulting in the recovery of at least some of the pressure lost as a result of the steam flowing through the first, Venturi section 16. The inventors have found that the pressure of steam passing through a Venturi, such as the first section 16, may be reduced by roughly 47%, which is quite significant and may necessitate increasing the upstream steam pressure to mitigate against such loss. However, with the nozzle 10 of FIG. 1, the presence of the second, pressure recovery, section 18 serves to recover at least a portion of such pressure loss. For example, the inventors have found that, with the nozzles described herein, roughly 78-85% of the pressure loss can be recovered. Consequently, instead of a 47% pressure reduction as indicated above, the nozzles described herein result in only a 7-10% pressure reduction in the fluid as it passes through the nozzle 10. This pressure recovery feature is further discussed below in reference to FIG. 6. Thus, by using a nozzle 10 as described herein, the need for increasing upstream steam pressure would be avoided.

Figure 2:
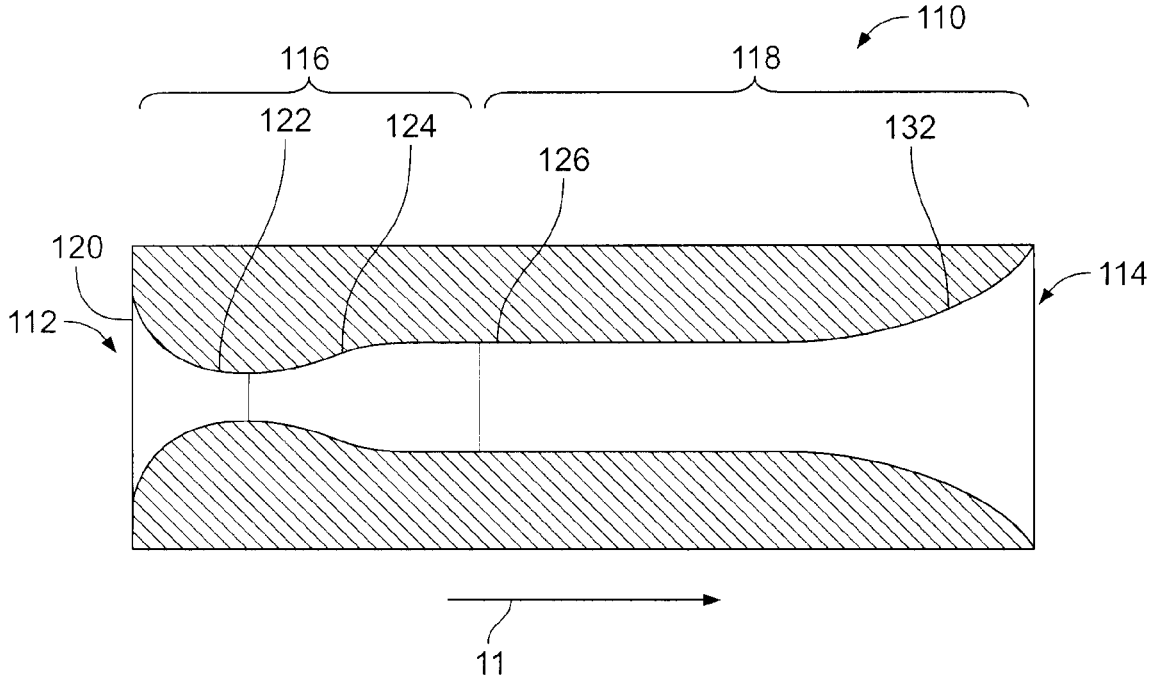
FIG. 2 is a side cross-sectional view of a steam injection nozzle according to another aspect of the description.

FIG. 2 illustrates another aspect of the nozzle described herein, wherein elements that are similar to those described above in relation to FIG. 1 are identified with like reference numerals but with the prefix "1". As shown in FIG. 2, a nozzle 110 includes an inlet 112 and an outlet 114 at the opposite ends of a passage extending through the nozzle 110. As before, the steam passing through the nozzle 110 flows in the direction 11. The nozzle 110 includes a first or Venturi section 116 having a first convergence zone 122 and a first divergence zone 124. Steam (or other fluid) from a pipe enters an opening 120 of the first convergence zone 122, passes through the first convergence zone 122, and then through the first divergence zone 124. A first generally constant cross-sectional area region 126, or "first region 126", is provided downstream of the first divergence zone 124 of the Venturi section 116. Similar to what was described above, fluid (steam) flowing through the first convergence zone 122 gains velocity but loses pressure. Some of the lost pressure is recovered in the first region 126 after the first divergence zone 124; however, a significant pressure difference would still exist between the upstream and downstream ends of the Venturi section 116.

In the example illustrated in FIG. 2, the second, pressure recovery, section 118 comprises only a second divergence zone 132, which functions in the same manner as the second divergence zone 32 described in relation to FIG. 1. Thus, the second divergence zone 132 of the pressure recovery section 118 creates shock waves that are generally normal to the direction of flow 11 of the steam. In the result, at least a partial recovery of the lost steam pressure is achieved in the same manner as discussed above.

In the figures shown herein, the convergence and divergence zones are illustrated with certain degrees of change. It will be understood that the passage extending through the nozzle may be provided with any variation in such geometries. In this way, the rate of convergence or divergence of the passage cross-sectional area may be provided on the nozzle in any desired manner.

Figure 3:
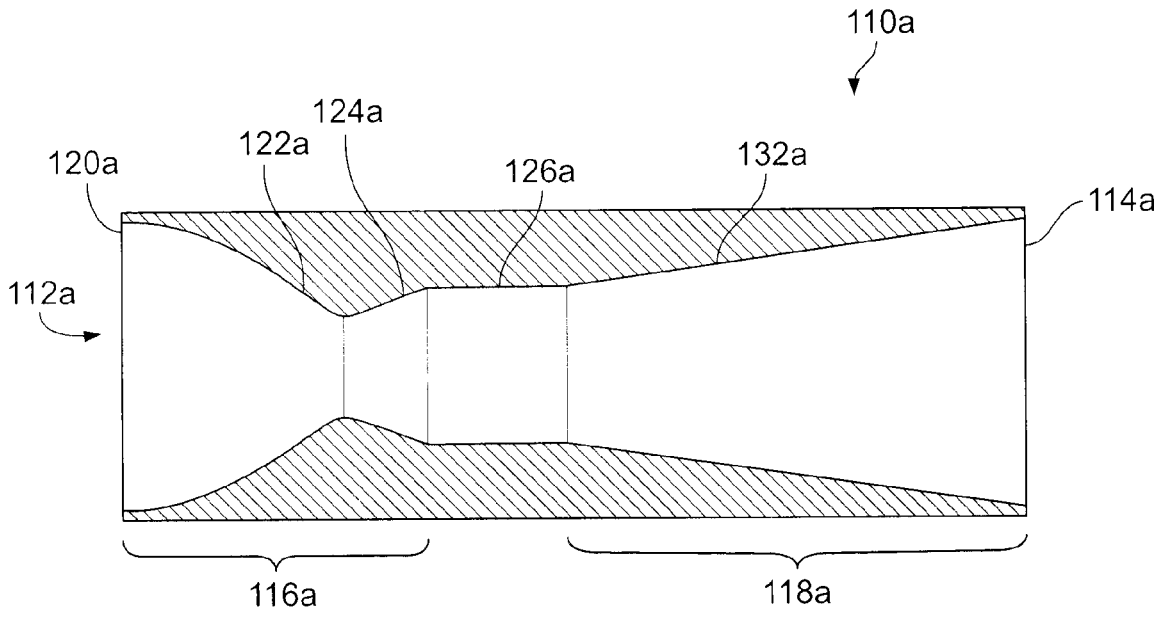
FIGS. 3 to 5 are side cross-sectional views of variations of the steam injection nozzle shown in FIG. 2.
Figure 4:
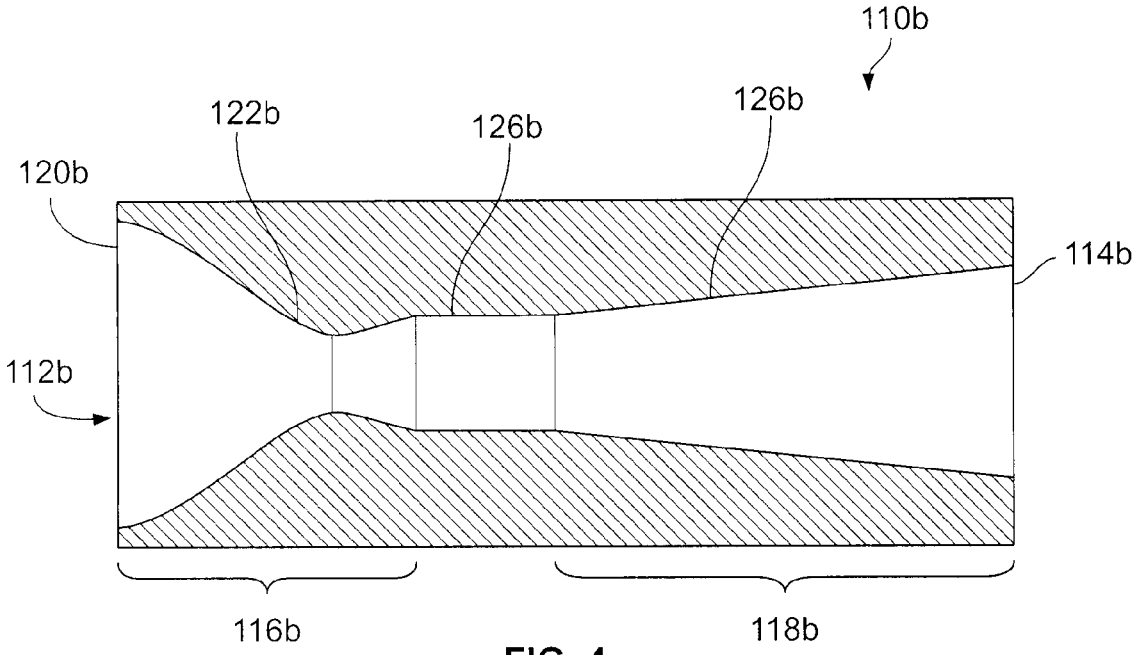
Figure 5:
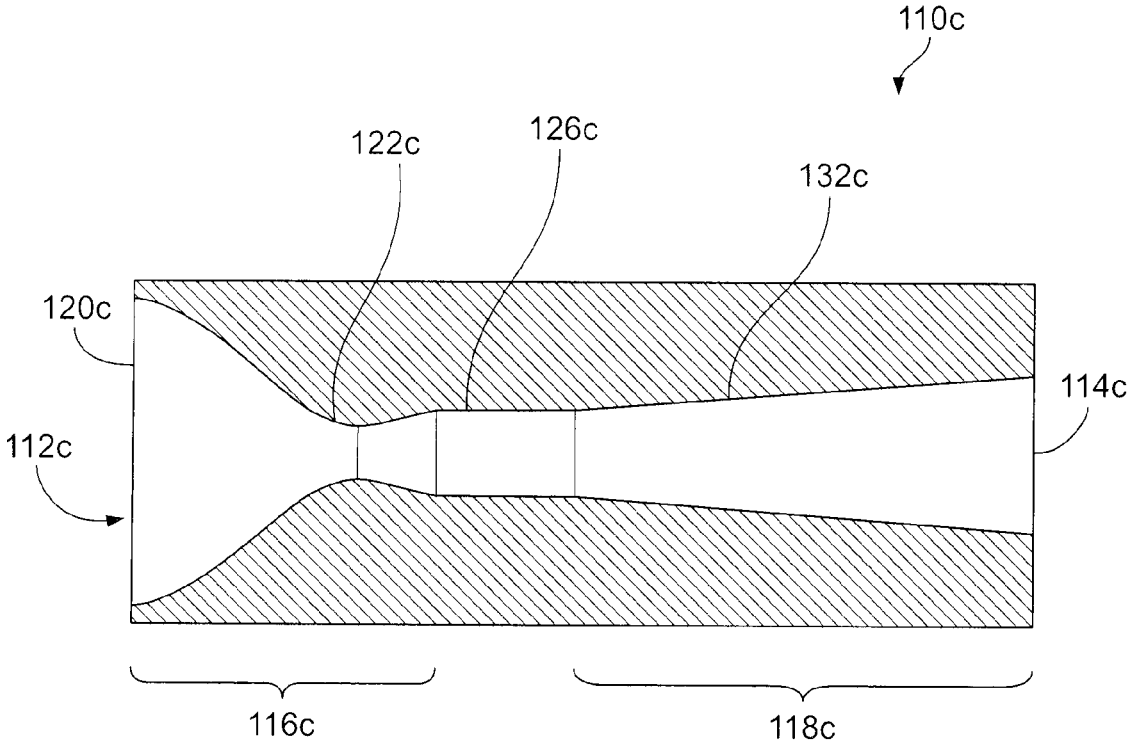

FIGS. 3 to 5 illustrate different variations of the nozzle as depicted in FIG. 2. In FIGS. 3 to 5, elements that are similar to those of FIG. 2 are identified with like reference numerals, but with the suffixes "a", "b", and "c", respectively, for clarity. As can be seen, the variations shown in FIGS. 3 to 5 lie primarily in the first, Venturi section 116*a*, 116*b* and 116*c*. In particular, the openings 120*a*, 120*b*, and 120*c* of the first convergence zones 122*a*, 122*b*, and 122*c* are illustrated with different relative sizes. By way of example, opening 120*a* may have a diameter of 6 mm, opening 120*b* may have a diameter of 9 mm, and opening 120*c* may have a diameter of 12 mm. As discussed above, the term "diameter" would generally apply to an element having a circular cross-section. For passages having non-circular cross-sections, the above-noted dimensions may comprise the minimum dimension of the opening.

Figure 6:
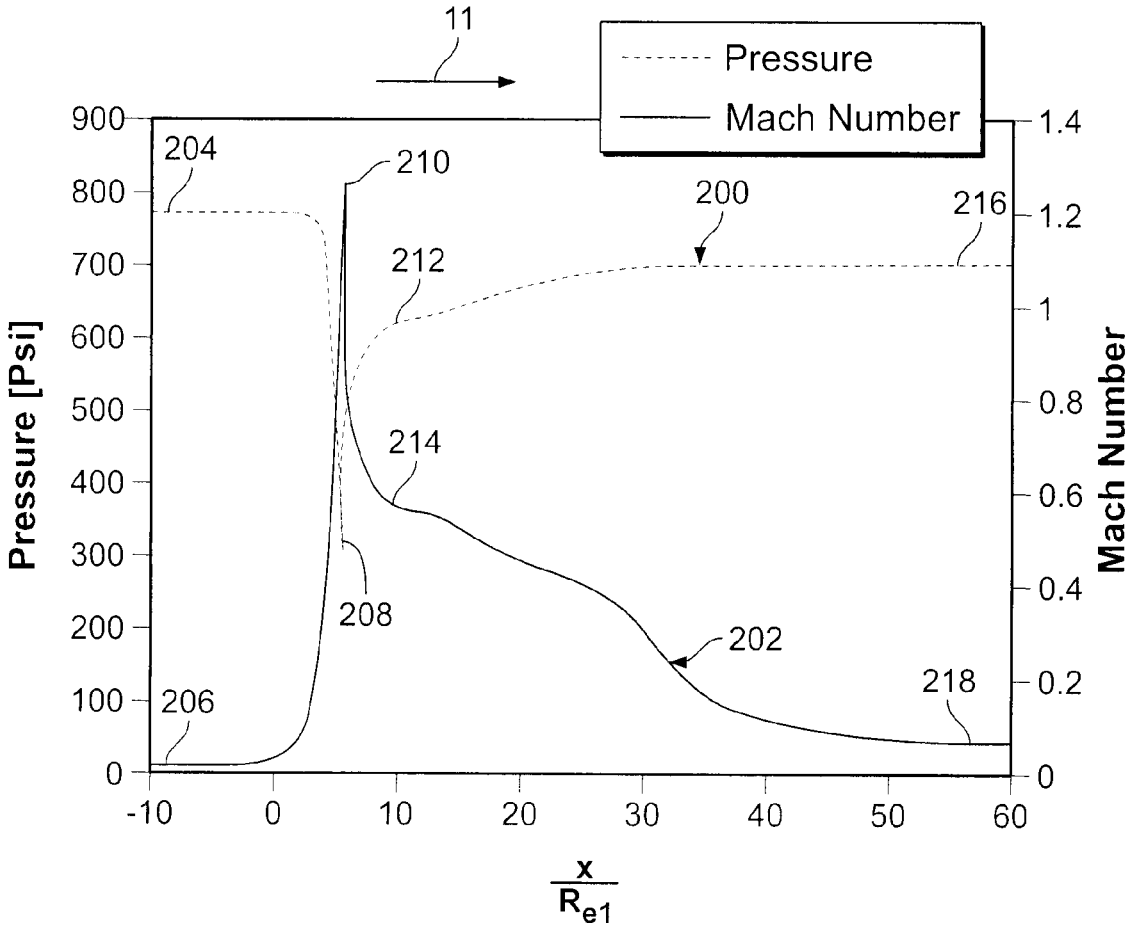
FIG. 6 illustrates the relationship between fluid pressure and velocity as it passes through a nozzle as described herein.

FIG. 6 illustrates a pressure and fluid velocity curves for a fluid flowing through a nozzle such as the nozzle of any one of FIGS. 2 to 5. The pressure curve in FIG. 6 is illustrated with the broken line 200 and the fluid velocity curve, as indicated by Mach number, is illustrated with the solid line 202. As can be seen, a fluid, flowing in the direction 11, enters the nozzle at a high pressure, as shown at 204, and low velocity, as shown at 206. Upon passing through the first convergence zone, it is seen that the pressure of the fluid is greatly reduced, as shown at 208, while the fluid velocity becomes supersonic (i.e. the velocity exceeds Mach 1 under the local conditions), as shown at 210. After the first divergence zone, it is noted that the pressure of the fluid is partially recovered, as shown at 212, and that the velocity of the fluid is reduced to subsonic levels, as shown at 214. However, by the time the fluid exits through the second divergence zone, the pressure is nearly fully recovered, as shown at 216, and the fluid velocity is returned to a value close to the entering velocity, as shown at 218. Thus, FIG. 6 illustrates the effectiveness of the nozzle described herein.

Figure 7:
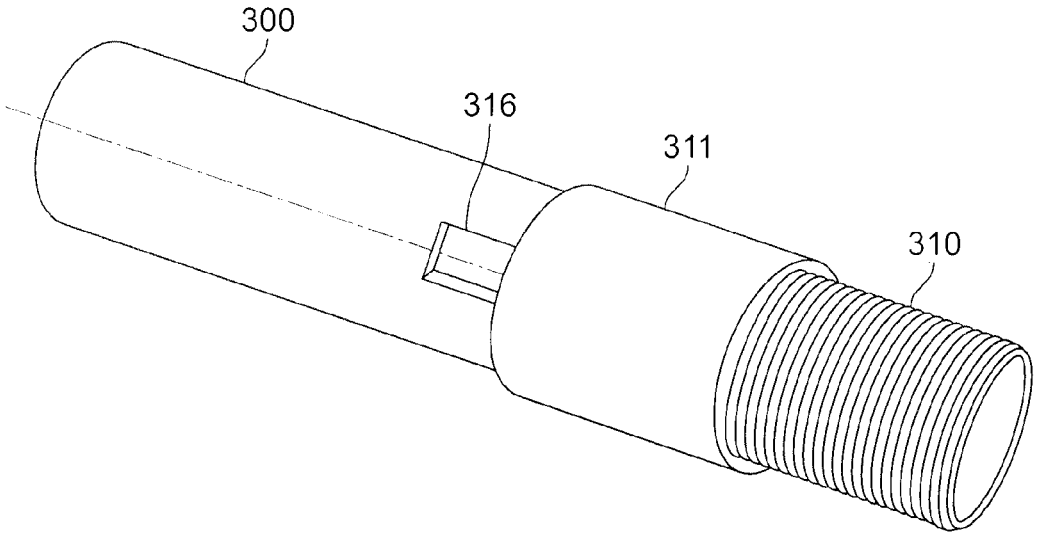
FIG. 7 is a top view of a pipe including a nozzle as described herein.
Figure 8:
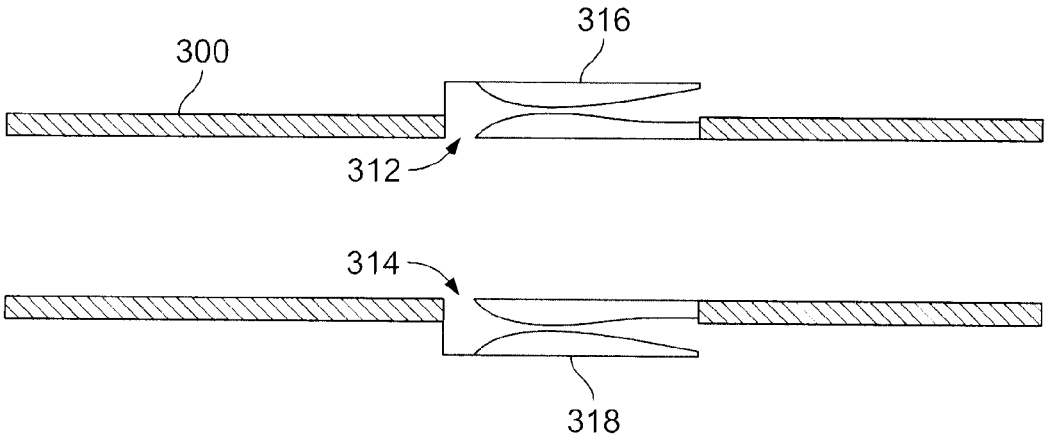
FIG. 8 is a side cross-sectional view of the pipe and nozzle of FIG. 7.

FIGS. 7 and 8 illustrate schematically one example of how the nozzles described herein may be provided on a base pipe. As shown, the base pipe 300 generally includes a screen 310, such as a wire wrap screen or the like (as known in the art), which is secured to the pipe 300 by a collar 311 or the like. For ease of illustration, the screen and collar are not shown in FIG. 8. The pipe 300 includes at least one port, such as shown at 312 and 314, to allow fluids to flow there-through. Nozzles 316 and 318, such as a nozzle as described herein, are positioned in one or more of the ports 312 and 314. In the illustrated aspect, both ports are provided with nozzles. In one aspect, steam injected into the lumen of the pipe 300 flows out through the port and through the nozzles. The steam then enters, or is injected, into the reservoir (not shown) through the screen 310.

In another aspect of the present description, a tubing system for a wellbore is provided, wherein a plurality of the steam injection nozzles described herein is provided along the length of such tubing. It will be understood that such nozzles may be the same or different.

In another aspect, a SAGD or CSS well treatment system is provided, wherein the system comprises one or more injection tubing having a plurality of the steam injection nozzles described herein. Such a system will be understood to have the necessary steam supply and pumping apparatus to inject steam through the tubing and ultimately through the nozzles.

Although the above description includes reference to certain specific embodiments, various modifications thereof will be apparent to those skilled in the art. Any examples provided herein are included solely for the purpose of illustration and are not intended to be limiting in any way. In particular, any specific dimensions or quantities referred to in the present description are intended only to illustrate one or more specific aspects are not intended to limit the description in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

I claim:

1. A steam injection nozzle for a pipe, the nozzle having:
an inlet and an outlet and a passage extending from the inlet to the outlet, the inlet having a circular shape, the passage comprising:
a pressure dissipation section downstream of the inlet, the pressure dissipation section comprising:
a convergence zone downstream of the inlet, the convergence zone comprising a region of reducing cross-sectional area;
a first divergence zone adjacent to and immediately downstream of the convergence zone, the first divergence zone comprising a region of increasing cross-sectional area; and,
a first region, adjacent to and immediately downstream of the first divergence zone, comprising a region of generally constant cross-sectional area; and,
a pressure recovery section adjacent to and immediately downstream of the pressure dissipation section and upstream of the outlet, the pressure recovery section comprising:
a second divergence zone, comprising a region of increasing cross-sectional area.

2. The steam injection nozzle of claim 1, wherein the convergence zone comprises a curved and narrowing passage wall.

3. The steam injection nozzle of claim 1, wherein the first divergence zone comprises a curved and expanding passage wall.

4. Steam injection nozzle of claim 1, wherein the second divergence zone comprises an expanding conical passage wall.

5. The steam injection nozzle of claim 1, wherein the second divergence zone comprises a curved and expanding passage wall.

6. The steam injection nozzle of claim 1, wherein the passage has a generally circular cross-section.

7. An apparatus for injection of steam into a subterranean reservoir, the apparatus comprising:
a base pipe for communicating fluids from the surface to the subterranean reservoir, the base pipe having at least one port extending through the wall thereof, the port being adapted to permit passage of steam from the base pipe into the reservoir;
a nozzle provided on or adjacent to the port and being retained against the base pipe;
the nozzle comprising:
an inlet and an outlet and a passage extending from the inlet to the outlet, the passage having:
a pressure dissipation section downstream of the inlet, the pressure dissipation section comprising:
a first convergence zone downstream of the inlet, the first convergence zone comprising a region of reducing cross-sectional area;

a first divergence zone downstream of the first convergence zone, the first divergence zone comprising a region of increasing cross-sectional area; and, a first region, downstream of the first divergence zone, comprising a region of generally constant cross-sectional area; and, a pressure recovery section downstream of the pressure dissipation section and upstream of the outlet, the pressure recovery section comprising:

a second divergence zone, comprising a region of increasing cross-sectional area.

8. The apparatus of claim 7, wherein the pressure recovery section further comprises:

a second convergence zone downstream of the pressure dissipation zone and upstream of the second divergence zone, the second convergence zone comprising a region of reducing cross-sectional area.

9. The apparatus of claim 8, wherein the pressure recovery section further comprises:

a second region, downstream of the second convergence zone and upstream of the second divergence zone, comprising a region of generally constant cross-sectional area.

10. The apparatus of claim 7, wherein the first convergence zone comprises a curved and narrowing passage wall.

11. The apparatus of claim 7, wherein the first divergence zone comprises a curved and expanding passage wall.

12. The apparatus of claim 7, wherein the second convergence zone comprises a narrowing conical passage wall.

13. The apparatus of claim 7, wherein the second divergence zone comprises an expanding conical passage wall.

14. The apparatus of claim 7, wherein the second divergence zone comprises a curved and expanding passage wall.

15. The apparatus of claim 7, wherein the passageway passage has a generally circular cross-section.

16. A method of injecting steam into a subterranean reservoir, the method comprising:

injecting steam from the surface into the reservoir through a base pipe, the base pipe having at least one port extending through the wall thereof and a nozzle associated with the port, wherein the steam is passed from the port through an inlet of the nozzle and through an outlet of the nozzle and into the reservoir;

wherein, during passage through the nozzle the injected steam is:

(a) subjected to a pressure dissipation downstream of the inlet, the pressure dissipation involving:

passing the steam through a first convergence zone downstream of the inlet, the first convergence zone comprising a region of reducing cross-sectional area;

passing the steam through a first divergence zone downstream of the first convergence zone, the first divergence zone comprising a region of increasing cross-sectional area; and, passing the steam through a first region, downstream of the first divergence zone, comprising a region of generally constant cross-sectional area; and, (b) subjected to a pressure recovery after the pressure dissipation, the pressure recovery comprising:

passing the steam through a second divergence zone, comprising a region of increasing cross-sectional area.

17. The method of claim 16, wherein step (b) further comprises:

passing the steam through a second convergence zone downstream of the first region and upstream of the second divergence zone, the second convergence zone comprising a region of reducing cross-sectional area.

18. The method of claim 17, wherein step (b) further comprises:

passing the steam through a second region, downstream of the second convergence zone and upstream of the second divergence zone, comprising a region of generally constant cross-sectional area.

* * * * *